United States Patent [19]

Dodd et al.

[11] 4,224,011

[45] Sep. 23, 1980

[54] COOLED ROTOR BLADE FOR A GAS TURBINE ENGINE

[75] Inventors: Alec G. Dodd, Belper; Anthony G. Gale, Wollaton; Derek A. Roberts, Almondsbury, all of England

[73] Assignee: Rolls-Royce Limited, London, England

[21] Appl. No.: 946,136

[22] Filed: Sep. 27, 1978

[30] Foreign Application Priority Data

Oct. 8, 1977 [GB] United Kingdom ..... 41960/77

[51] Int. Cl.[3] ..... F01D 5/18

[52] U.S. Cl. ..... 416/97 R; 416/192

[58] Field of Search ..... 416/92, 97, 192; 415/115

[56] References Cited

U.S. PATENT DOCUMENTS

| | | | |
|---|---|---|---|
| 3,816,022 | 6/1974 | Day | 416/92 |
| 3,876,330 | 4/1975 | Pearson et al. | 416/97 |
| 3,989,412 | 11/1976 | Mukherjee | 416/97 |
| 4,017,209 | 4/1977 | Bodman | 416/97 |
| 4,127,358 | 11/1978 | Parkes | 416/97 |

FOREIGN PATENT DOCUMENTS

| | | | |
|---|---|---|---|
| 221747 | 8/1958 | Australia | 415/115 |
| 2350624 | 5/1974 | Fed. Rep. of Germany | 415/172 A |

*Primary Examiner*—Everette A. Powell, Jr.
*Assistant Examiner*—A. N. Trausch, III
*Attorney, Agent, or Firm*—Cushman, Darby & Cushman

[57] ABSTRACT

A cooled rotor blade for a gas turbine has an aerofoil in which there are longitudinally extending cooling fluid passages. At the tip of the aerofoil is located a separate, chordwise extending tube. The tube has apertures in its wall which correspond with at least some of the cooling fluid passages, whereby the spent cooling fluid from these passages may pass through the tube to rejoin the gas flow of the engine.

7 Claims, 6 Drawing Figures

COOLED ROTOR BLADE FOR A GAS TURBINE ENGINE

This invention relates to a cooled rotor blade for a gas turbine engine.

It is common practice for some of the rotor blades of a gas turbine engine to be provided with cooling arrangements, which normally involve the supply of a cooling fluid to passages within extending the aerofoil of the blade. These passages usually extend longitudinally of the blade, and exhaust some of the cooling air at the blade tip.

It has always been difficult (a) to effectively blank off or restrict the passages which reach the tip of the blade and are not required to be completely open and (b) to direct the spent cooling air from the tip of the blade in such a way as to effectively use the energy in the air and not to interfere with the sealing at the blade tip. Separate plates welded or brazed to the blade tip have been used to deal with (a); these can under extreme conditions come loose and damage the engine. Various forms of fences and caps have been used for (b), but these have tended to be heavy and complex to manufacture.

The present invention relates to a blade whose cooling system is terminated at its tip in a mechanically and aerodynamically effective manner.

According to the present invention a cooled rotor blade for a gas turbine engine comprises an aerofoil having longitudinally extending cooling fluid passages therein, and a separate chordwise extending tube attached to the tip of the aerofoil, the tube having at least one aperture in its wall corresponding with at least one said cooling fluid passage, whereby the spent cooling fluid from said passage passes through said tube to rejoin the gas flow of the engine.

Preferably the tube is mechanically retained to the tip of the aerofoil.

Normally the tube would be blanked off at its forward end and open at its rearward end, which may be cut-away so as to leave at least one upstanding wall portion which acts as a deflector for gas in the region of the blade tip.

Preferably the blade is of the shrouded type, and the tube is attached to that face of the shroud remote from the gas flow of the engine.

In this case the said face of the shroud may carry sealing fins through which the tube passes.

In addition to its use for channelling spent cooling fluid into the gas flow of the engine, the tube may be used as an interconnection between different longitudinal cooling fluid passages in the blade.

Figure 1:
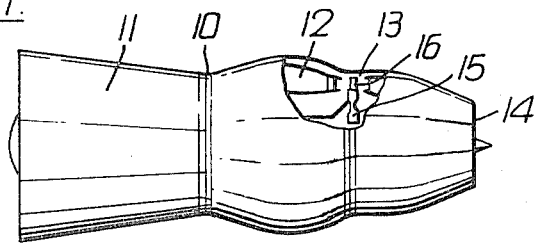
Figure 2:
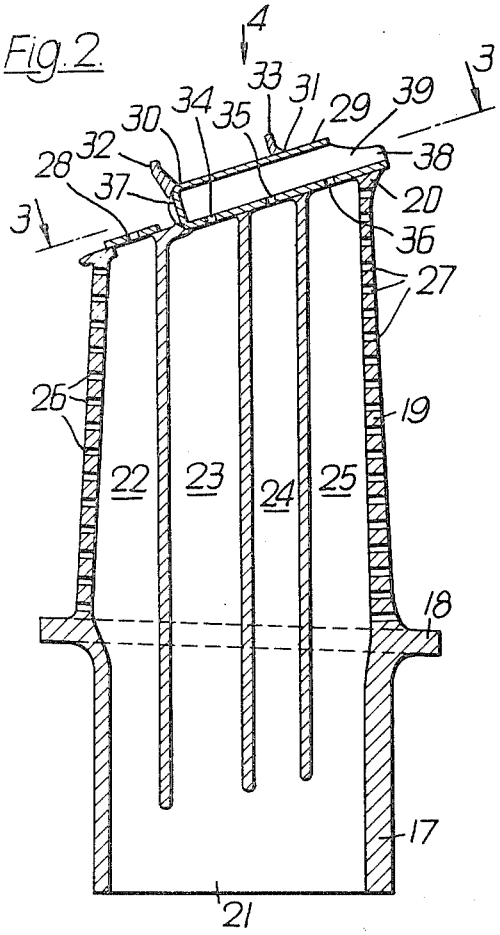
Figure 3:
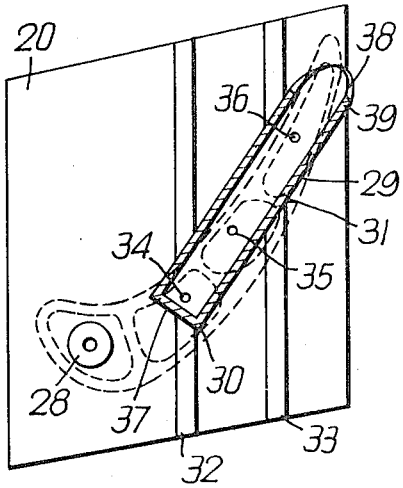
Figure 4:
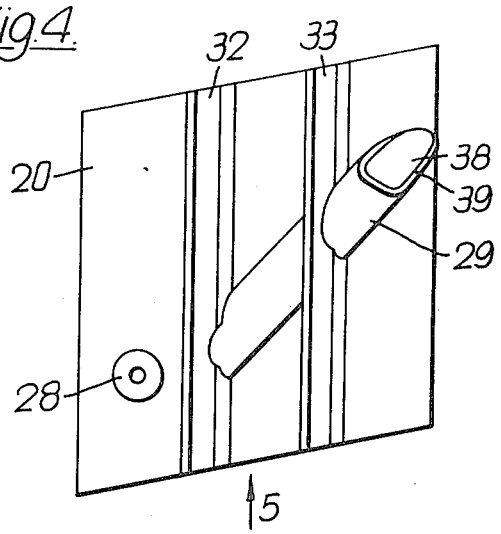
Figure 5:
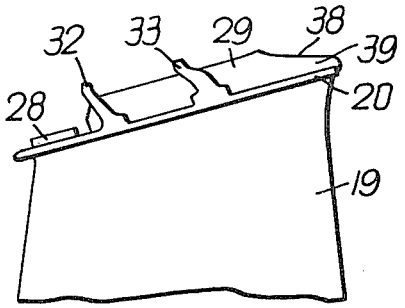
Figure 6:
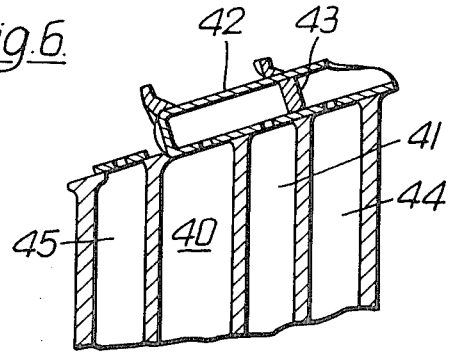

The invention will now be particularly described, merely by way of example with reference to the accompanying drawings in which:

FIG. 1 is a side view of a gas turbine engine having blades in accordance with the invention, FIG. 2 is an enlarged chordwise section through one of the blades of FIG. 1, FIG. 3 is a section of the complete tip shroud on the line 3—3 of FIG. 2, FIG. 4 is a view of the top of the shroud taken on the arrow 4 of FIG. 2, FIG. 5 is a side view of the tip of the blade taken on the arrow 5 of FIG. 4, and FIG. 6 is a view similar to the upper part of FIG. 2 but of a further embodiment.

In FIG. 1 there is shown a gas turbine engine having a casing 10 within which are located in flow series a compressor 11, combustion section 12 and turbine 13, and which terminates as a final nozzle 14. Operation of the engine is broadly conventional and is not therefore described herein.

The casing of the engine is cut away in the region of the turbine 13 to expose to view the turbine rotor which comprises a rotor disc 15 on the periphery of which are supported a row of rotor blades 16. Because the blades operate in a very hot environment they are provided with a cooling system which makes use of relatively cool air passing along channels within the blade to provide cooling.

FIG. 2 shows the structure of the blade which enables this cooling to take place. The blade comprises a root 17, a platform 18, an aerofoil 19 and a tip shroud 20, all these features being formed as a single casting to produce an integral whole. The root 17 has an aperture 21 at its extremity to allow cooling air to enter the blade, and the aperture 21 communicates with a number of passages which extend through the root and the aerofoil 19. In the illustrated embodiment these passages comprise a leading passage 22 which extends through the leading edge region of the aerofoil, two intermediate passages 23 and 24 which extend through the central region of the aerofoil, and a trailing passage 25 which extends adjacent the trailing edge region of the aerofoil.

The cooling air entering these four passages from the aperture 21 is disposed of in different ways. In the passage 22 the majority of the air is allowed to flow to the surface of the blade via a series of film cooling holes 26, to provide film cooling of the surface of the blade in known manner. The air flowing in the passages 23 and 24 is all allowed to exhaust at the tip of the blade via structure described below. The passage 25 is provided with a series of exhaust holes 27 which allow the majority of the air to exhaust through the trailing edge of the blade to cool this critical region. In each of these passages there is a requirement for an aperture to be formed at the tip extremity; these apertures either allow the total flow in the passage to exhaust (as 23 and 24) or are 'dust holes' which allow a small residual flow to avoid stagnant areas within the passages (as 22 and 25). It is difficult to produce these small apertures accurately by the casting process used to make the rest of the blade; other expedients must therefore be used.

The passage 22 shows an example of the kind of construction used prior to the present invention. It will be seen that the extremity of the passage where it breaks through the shroud 20 is almost of the same size as the rest of the passage. In order to restrict this aperture to the necessary size, an apertured plate 28 is brazed to the upper surface of the shroud. This successfully restricts the aperture, but since it depends on a brazed joint for its retention to the shroud, it will detach from the shroud if the temperature exceeds the melting point of the braze material, which is of course less than that of the parent material.

In order to overcome this problem, in accordance with the present invention the remaining passages 23, 24 and 25 exhaust at their tip ends into a hollow tube 29. This tube passes through apertures 30 and 31 formed in the forward and rearward radially extending sealing fins 32 and 33 respectively which extend from the upper surface of the shroud.

The tube has apertures 34, 35 and 36 in its wall, sized and positioned to restrict to a predetermined extent the extremities of the passages 23, 24 and 25 respectively which break through the shroud 20 as large apertures in a similar manner to the passage 22. Therefore the tube acts in a similar manner to the plate 28, but because it passes through the fins 32 and 33, and may also be embedded in the metal of the shroud 20, it is mechanically restrained from radial movement and can withstand higher temperatures than the plate 28.

At its forward extremity the tube 29 is blanked off by a closure 37, and this end does not completely extend through the forward fin 32. The material of the fin in fact extends round the front of the closure 37 and therefore provides location of the tube in the fore and aft direction.

At its rearward extremity the tube 29 is open at 38 to allow the cooling air to rejoin the gas flow of the engine. The tube has to lie at an angle approximating to that of the trailing region of the blade in order to allow the passages in the blade to communicate with the tube interior. It is therefore at approximately the correct angle to allow the outflowing cooling air to use its energy in providing some additional impetus to the rotor blade. This is therefore a second advantageous feature of the tube.

Additionally it will be noted that the open end 38 is shaped in such a way as to leave one wall 39 of the end of the tube upstanding so that it acts as a deflector for general air flows in the vicinity of the shroud. In fact, the air flow which will be mainly influenced by the deflector 39 is the leakage air which flows over the upper surface of the shroud and past the fins 32 and 33. This leakage air represents a penalty to the performance of the turbine; if some of its energy can be abstracted as by the deflector 39 this reduces the loss.

It should be noted that as well as providing the aerodynamic and structural advantages referred to above, the use of the tube 29 enables the manufacturing process of the blade to be improved. Thus when the aerofoil is cast, the channels within the aerofoil are normally produced by the use of a ceramic core having the shape of the required cavities in the blade. This core tends to be fragile and its breakage in handling or in the casting process is a major source of scrap. Because the tube 29 requires a correspondingly shaped cavity in the cast aerofoil within which to fit, the core required for the blade shown will have all the separate cores which would produce the channels 23, 24 and 25 interconnected by the cylindrical core which produces the tube cavity. Thus the complete core will be greatly strengthened compared with the noninterconnected version and should reduce the scrap rate.

It should be noted that the embodiment described represents only one form of the invention, and a number of alternative constructions are possible. Thus in particular a tube such as 29 could form a useful interconnecting passage for the longitudinal passages within the blade. FIG. 6 shows how this could be done; hence the two central passages 40 and 41 are interconnected by part of the tube 42 which is blocked half way along its length by a partition 43. The rearward portion of the tube 42 still provides an outflow passage for the air from the trailing passage 44.

In this case it is necessary to dispose of the air from the passages 40 and 41; this could be done using film cooling holes communicating with the blade surface or the passage 41 could if necessary communicate with a passage such as 44 or the leading passage 45.

Clearly it would be possible to use the tip combination of the invention with a shrouded or unshrouded blade; it is also evident that a variety of different aerofoil cooling layouts would benefit from the use of the invention.

We claim:

1. A cooled blade for a rotor of a gas turbine engine comprising:

an aerofoil, a tip portion and a root portion integrally formed as a whole, cooling fluid passages extending longitudinally through said aerofoil with at least one of said passages being open at one end to said tip portion, a chordwise extending tube having a closed end and an open end and at least one aperture in its wall communicating with the open end of said at least one of said cooling fluid passages, said tube receiving spent cooling fluid from said passages through said aperture and discharging the same through the cooling tube's open end to rejoin gas flow of the engine, and means mechanically attaching said tube directly to said tip portion to positively restrain said tube against radial movement caused by centrifugal forces regardless of temperatures encountered by the blade.

2. A cooled blade as claimed in claim 1 wherein said means includes circumferentially extending fins integrally formed as part of said tip portion, said fins having apertures therethrough for receiving said tube and restraining the same against radial movement.

3. A cooled rotor blade as claimed in claim 2 in which said tip portion is a shroud portion for the rotor.

4. A cooled rotor blade as claimed in claim 1 and in which said aerofoil has leading and trailing edges and said tube has extremities closer to the leading and trailing edges respectively, the extremity of the tube closer to the leading edge being blanked off and the extremity closer to the trailing edge being open.

5. A cooled rotor blade for a gas turbine engine comprising:

an aerofoil having leading and trailing edges, a tip portion and a root portion integrally formed as a whole, said tip portion being a shroud portion of the rotor having one face contacting gas flow of the engine and other face remote from gas flow of the engine, said shroud portion being provided on the remote face thereof with sealing fins having apertures therethrough, longitudinally extending cooling passages in said aerofoil with at least one of said passages having an open end in the shroud portion, a separate chordwise extending tube closed at one end and open at the other end thereof and having at least one aperture in its wall communicating with the open end of said at least one of said passages, said tube extending through apertures in said fins so as to provide a mechanical engagement between the tube and the blade to restrain the tube against radial movement caused by centrifugal forces regardless of temperatures encountered by the blade, said tube having the closed end thereof positioned closer to the leading edge than the open end thereof, and the open end thereof being arranged to deliver spent cooling fluid from said passages to the gas flow of the engine.

6. A cooled rotor blade as claimed in claim 5 and in which the tube is cut-away at said open extremity to leave at least one upstanding wall portion which acts a deflector for gas in the region of the blade tip.

7. A cooled rotor blade as claimed in claim 5 and in which at least part of the tube is divided off from that portion which allows spent cooling fluid to rejoin the engine gas flow, the divided position communicating with at least two said cooling fluid passages so as to form an interconnection therebetween for the flow of cooling fluid.

* * * * *